United States Patent [19]

Jardine

[11] 4,441,902

[45] Apr. 10, 1984

[54] HEAT RECLAIMING METHOD AND APPARATUS

[75] Inventor: Douglas M. Jardine, Colorado Springs, Colo.

[73] Assignee: Kaman Sciences Corporation, Colorado Springs, Colo.

[21] Appl. No.: 344,984

[22] Filed: Feb. 2, 1982

[51] Int. Cl.[3] ..... F25B 27/02

[52] U.S. Cl. ..... 62/238.6; 62/183; 62/506

[58] Field of Search ..... 62/238.6, 183, 506

[56] References Cited

U.S. PATENT DOCUMENTS

| | | | |
|---|---|---|---|
| 2,668,420 | 2/1954 | Hammell | 62/238.6 X |
| 4,293,093 | 10/1981 | Raymond et al. | 62/238.6 X |
| 4,314,456 | 2/1982 | Harnish | 62/238.6 X |
| 4,316,367 | 2/1982 | Yaeger et al. | 62/238.6 |
| 4,321,797 | 3/1982 | Yaeger et al. | 62/238.6 |
| 4,367,634 | 1/1983 | Bolton | 62/238.6 |

*Primary Examiner*—Lloyd L. King

*Attorney, Agent, or Firm*—Max L. Wymore

[57] ABSTRACT

Method and apparatus to extract heat by transferring heat from hot compressed refrigerant to a coolant, such as water, without exceeding preselected temperatures in the coolant and avoiding boiling in a water system by removing the coolant from direct or indirect contact with the hot refrigerant.

2 Claims, 2 Drawing Figures

HEAT RECLAIMING METHOD AND APPARATUS

The government has rights in this invention pursuant to Contract No. DE-AC03-79CS30207 awarded by the U.S. Department of Energy.

BACKGROUND OF THE INVENTION

The present invention relates generally to a heat reclaiming method and apparatus, and more particularly to a method and apparatus for reclaiming the normally wasted heat rejected by the refrigerant of a refrigeration circuit by transferring such heat to a hot water heat sink.

Refrigeration systems generally comprise a compressor, condenser, and expansion device, and an evaporator connected by appropriate refrigerant lines to form a refrigeration circuit. Refrigerant vapor is compressed by the compressor and fed to the condenser where the refrigerant rejects heat to a cooling medium and condenses. The condensed refrigerant then flows through the expansion device, reducing the pressure and temperature of the refrigerant. From the expansion device, the refrigerant passes into the evaporator, absorbs heat from a medium which is thereby cooled, and vaporizes. Vaporous refrigerant is then drawn back into the compressor, completing the circuit.

Such refrigeration circuits are frequently employed to cool a fluid such as air which is circulated through various rooms or areas of a building to cool these areas. Often the refrigerant of such a circuit rejects a relatively large amount of heat at the condensor of the circuit. This rejected heat is commonly dissipated to the atmosphere, either directly or via a cooling fluid that circulates between the condenser and a cooling tower. Over a period of time, the rejected heat represents a substantial waste of energy, and recently much attention has been directed to reclaiming or recovering this heat.

One general approach to reclaiming this heat has been to position a heat reclaiming heat exchanger between the compressor and condenser of the refrigeration circuit wherein the hot, compressed refrigerant vapor discharge from the compressor flows through the added heat exchanger. Water is circulated through the heat reclaiming heat exchanger in heat transfer relation with the vapor passing therethrough and heat is transferred from the vapor to the water, heating the water and cooling the vapor. The heated water is conducted to a storage tank where the water may be stored for later use, and the cooled vapor is directed to the condenser of the refrigeration circuit where the vapor is further cooled and condensed.

Numerous patents have been granted to systems for utilization and recovery of this waste heat.

U.S. Pat. No. 4,254,630 is directed to a heat reclaiming method and apparatus for use in a vapor compression refrigeration circuit. The apparatus comprises a heat exchanger connected to a compressor and a condenser of the refrigeration circuit for receiving refrigerant vapor from the compressor and discharging the refrigerant to the condenser wherein the refrigerant vapors pass in heat transfer relation with heat transfer fluid to heat the fluid and cool the vapors. The heat exchanger is further connected to a source of the heat transfer fluid for receiving fluid therefrom and still further connected to the heat storage facility for discharging the heat transfer fluid thereto, The heat reclaiming apparatus further comprises a valve for regulating the flow of heat transfer fluid to the heat exchanger; and a control for controlling the valve to decrease the quantity of heat transfer fluid flowing to the heat exchanger when a temperature of the heat transfer fluid discharged therefrom falls below a predetermined value.

U.S. Pat. No. 4,251,996 is directed to a heat reclaiming method and apparatus which comprises a heat reclaiming condenser connected to the refrigeration circuit for receiving refrigerant vapor therefrom and discharging condensed refrigerant thereto further connected to a source of heat transfer fluid for receiving fluid therefrom still further connected to the heat storage facility for discharging the heat transfer fluid thereto wherein refrigerant vapor passes in heat transfer relation with the heat transfer fluid to heat the fluid and condense the refrigerant vapors. A valve is provided for regulating the flow of heat transfer fluid to the heat reclaiming condenser and a valve control for controlling the valve to decrease the quantity of heat transfer fluid flowing to the heat reclaiming condenser when the condensed refrigerant reaches a predetermined level.

U.S. Pat. No. 4,238,931 is directed to a waste heat recovery system controller for use in a waste heat recovery subsystem utilizing a heat exchanger, such as a refrigeration system having a heat exchanger for extracting and recovering heat energy from the superheated refrigerant by means of a transfer fluid. A combination of three interactive control systems is provided for control of the flow of heat transfer fluid through the heat exchanger. A first sensor means determines when the waste heat temperature is sufficiently high and controls a pump to obtain a circulation of the fluid when such temperature exceeds a preselected value. A second sensor monitors the temperature of the heat transfer fluid and stop circulation of the fluid when such temperature exceeds a preselected safe upper limit. A third sensor monitors the transfer fluid temperature at the outlet of the heat exchanger and controls the rate of flow of fluid in a manner proportional to such temperature.

U.S. Pat. No. 4,281,519 is directed to a refrigeration circuit heat reclaiming method and apparatus wherein heat energy is exchanged between a refrigeration circuit and a hot water system. A restricted flow bypass line is used in conjunction with a pump continuously operated with a compressor of the refrigeration system such that a continual restrictive flow of water bypasses the water or the heat exchanger when temperature conditions are such that water is not flowing through the heat exchanger.

U.S. Pat. No. 4,199,955 is directed to heat extraction or reclamation apparatus for a refrigerating and air conditioning system. This system is adapted to recover otherwise rejected heat from the refrigerant gas flowing through air conditioning and refrigeration systems and includes a counterflow heat exchanger for transferring heat to a medium such as water which heat exchanger is installed upstream of the conventional condenser. The heat extraction system has a pump for circulating water or other medium to be heated, located on one side of the heat exchanger. Hot refrigerant gas from the compressor is circulated through the other side of the heat exchanger. The pump flow rate in the heat transfer area between the refrigerant gas and the water are chosen to insure that the refrigerant gas outlet quality remains within limits which insures flow continuity and operation. Refrigerant gas leaving the system will contain some liquid in the form of droplets. The water temperature is maintained within limits by stopping the pump when the inlet pressure change pressure to water temperature reaches the predetermined maximum value.

U.S. Pat. No. 3,922,876 is directed to an energy conservation unit for utilizing waste heat, from an air conditioner for refrigeration systems, to heat water. The system includes a heat exchanger coupled in the output of the compressor of the air conditioner for a refrigeration system and to a water reservoir for effecting heat transfer. A pump is interposed between the water reservoir and the heat exchanger for circulating the water. A temperature sensor thermally coupled to the water and electrically coupled to the pump is provided for rendering the pump inoperative when the temperature of the water in the reservoir is at or above a preselected temperature. A temperature operated valve is interposed between heat exchanger and the reservoir such that only water heated to a predetermined temperature is delivered to the reservoir.

U.S. Pat. No. 2,668,420 is directed to a combination water heating and room cooling system and method employing heat pumps providing an improved control network for a combination heating and cooling system so that a system may be readily set primarily for heating water or primarily for both heating and cooling the room.

Thus, in the typical vapor compression refrigeration system, various components such as the compressor, condenser, evaporator and expansion device are arranged to transfer heat energy between the fluid in heat exchange relation with the evaporator and fluid in heat exchange relation with the condenser. It is also known in conjunction with such refrigeration systems to utilize a desuperheater for removing superheat energy from gaseous refrigerant prior to circulating said refrigerant to the condenser.

In a conventional building installation, a hot water heater is provided to supply heated water to an enclosure.

Many hot water heaters have a cold water inlet connected to an inlet extension pipe and a hot water outlet extending through the top of a hot water tank. Often, an inlet extension pipe is connected to the cold water inlet such that the incoming water is directed to the bottom portion of the tank. In hot water tanks, water is heated at the bottom of the tank and rises such that a stratified tank with relatively warm water at the top and cool at the bottom is provided. When demand is made for hot water, water is discharged from the top of the tank at its warmest temperature and cold water is supplied through the inlet to the bottom portion of the tank.

It is known to combine a refrigeration system and hot water heating system such that the superheat of the refrigerant may be rejected to water to be heated such that this heat energy may be utilized to provide hot water.

In air conditioning systems when cooling is required, heat energy is transferred from the enclosure and discharged to the ambient or some other heat sink. This heat is often wasted. With combination systems as disclosed herein, it can be seen that this heat energy which is unwanted in the enclosure may be utilized to supply heat energy to water to provide heat and water for various uses. This heated water may be used for bathing, cleaning, cooking or other uses in a home or business. Commercial applications include restaurants, supermarkets, process utilization and any other application wherein wasted energy or excess energy from a refrigeration system may be utilized to provide some or all of the hot water heating needs.

In addition to refrigeration systems providing excess heat for heating water during the cooling season, certain refrigeration circuits are capable of reversing the cycle of operation for providing heat energy to the enclosure during the heating season. If it is desirable, some of the heat provided during the heating season may also be utilized to supply hot water through a hot water heater refrigerant desuperheater.

The energy situation and related economic instability are serious long-term problems. The refrigerant cycle can be employed to conserve energy and save money by heating hot water with the heat available in the superheater refrigerant of the refrigerant cycle. Where the refrigerant cycle is used for cooling, service such as air conditioning and food preservation, heat available to heat hot water is 100% waste heat, and it can be used beneficially to conserve non-renewable energy and greatly reduce water heating costs. Where the refrigeration cycle is used in the form of the heat pump, the same holds true for cooling cycle operation. With heating cycle operation, the available portion of the heat brought in through the evaporator and the heat equivalent of compressor work are available to heat hot water. The heat brought into the evaporator in the heat pump cycle, is generally from renewable sources such as ambient air, low temperature geothermal, and solar energy, converted heat or waste heat. The heat equivalent of compressor work is non-renewable energy for most refrigerant cycles such as electric power or natural gas. Photovoltaic or solar powered Rankine cycle driven heat pumps are examples where the heat equivalent of compressor work would be renewable energy.

In the specific embodiment disclosed, a pump is used to circulate water from the hot water tank through the heat exchanger and back to the hot water tank when the compressor of the refrigeration circuit is energized. A temperature sensing device is located to sense the temperature of the water in the hot water tank and when the temperature of the water therein falls below a predetermined value, the circulation pump is actuated to pump water through the heat exchanger back to the hot water tank for storage. When the refrigeration compressor operates in response to load requirements, cool water from the lower portion of the hot water storage tank is circulated by hot water circulator pump through the double-walled superheat refrigerant to the water heat exchanger. The water is heated in the heat exchanger and is pumped back to the upper portion of the hot water storage tank. The hot water stays in the upper part of the storage tank because of its lower density than the cold water. Preferably, the hot water storage tank is insulated to reduce heat loss by conduction and radiation from the tank surface. When hot water is withdrawn from the storage tank, it is drawn from the top of the tank where the hottest water resides. The cold water flows into the tank horizontally and rises uniformly in the tank as hot water is withdrawn from the top.

When the refrigerant compressor is not operating, a standby heater operates to maintain a desired water temperature in the upper 20%–30% of the tank. The standby heater is operated automatically by a thermostatically controlled switch which actuates upon the storage tank water temperature falling below a predetermined temperature. In like manner, the switch deactivates when the water temperature rises to the desired level. A two-position three-way automatic drain valve is positioned between the outlet of the pump and the inlet of the heat exchanger and a check valve is positioned between the outlet of the heat exchanger and the inlet to the hot water storage tank. An air bottle or other source of air is connected through a valve to a point between the outlet of the heat exchanger and the inlet to the check valve.

When the water temperature in the hot water storage reaches a predetermined upper temperature limit, the limit switch positioned in the upper part of the hot water tank actuates the two-position three-way automatic valve to cause closing of the valve to the outlet of the pump and opening a passage between the heat exchanger and an external drain. The draining operation reduces the water pressure in the heat exchanger and due to the higher water pressure in the storage tank, the check valve will close isolating the water side of the superheated refrigerant to heat exchanger from the water directed to the hot water storage tank. The compressed air in the air bottle is introduced into the line between the check valve and the heat exchanger purging the water in the heat exchanger through the external drain to prevent the generation of steam and overheated water within the refrigerant cycles desuperheating hot water heater heat exchanger.

When the water temperature in the hot water storage tank falls below the setting of the high temperature switch, the two-position three-way valve returns to normal operation for conducting of water from the pump to the heat exchanger. The water pumped through the heat exchanger compresses the trapped air back into the air bottle and equalizes the water pressure on both sides of the check valve which opens.

The prior art devices disclose operating the pump continuously with a compressor, the use of a solenoid valve or other valve to control the flow of water through the heat exchanger and the use of a bypass line to circulate the flow of water around the heat exchanger when the water temperature exceeds a safe limit. None of the prior art disclosures discloses the combination of a temperature sensitive relief valve positioned in the hot water storage tank to heat exchanger circuit which coacts with a check valve and air supply between the heat exchanger and the hot water tank to purge the heat exchanger of water when a predetermined high temperature limit is detected in the hot water storage tank.

SUMMARY OF THE INVENTION

It is an object of the present invention to provide a combination hot water heater and refrigerant desuperheater accessory for installation in conjunction with a refrigeration circuit and a hot water system for transferring heat energy from the refrigeration circuit to the hot water system.

It is a further object of the present invention to provide a method of transferring heat energy from a refrigeration circuit to a hot water system.

It is still a further object of the present invention to provide a refrigerant cycle desuperheating hot water heater which prevents the generation of steam and superheated water within a refrigerant cycle desuperheating hot water heater.

These and other objects are achieved according to the preferred embodiment of the invention wherein there is disclosed a combination pump which operates when the temperature of the water in the hot water storage tank falls below an upper limit switch setting wherein the water is pumped from the hot water storage tank through the heat exchanger and in indirect heat exchange with the compressed refrigerant to heat the water which is then returned to the hot water storage tank. When the water temperature in the water storage tank exceeds a predetermined value, a limit switch is actuated deactivating the pump and at the same time opening a two-position three-way automatic valve to close the outlet from the pump and to open the heat exchanger to the atmosphere which heat exchanger is purged of any liquid water. A one-way check valve is positioned between the inlet of the heat exchanger and the inlet to the hot water storage tank to prevent water in the storage tank from being introduced into the heat exchanger. Additionally, there is provided in the hot water storage tank a cold water inlet means and a hot water outlet means for thermally stratifying the more dense cold inlet water from the heated hot water stored for use in the upper portion of the tank.

DESCRIPTION OF THE PREFERRED EMBODIMENT

The embodiment described herein will be in conjunction with a vapor compression refrigeration system in combination with a residential-type hot water tank. It is to be understood that the invention applies likewise to various types of refrigeration circuits wherein the refrigerant is superheated and additionally to various size units such as residential, commercial and industrial. Additionally, although the hot water system as described herein is appropriate for a residential application, commercial and other size hot water system would be equally suitable.

Figure 1:
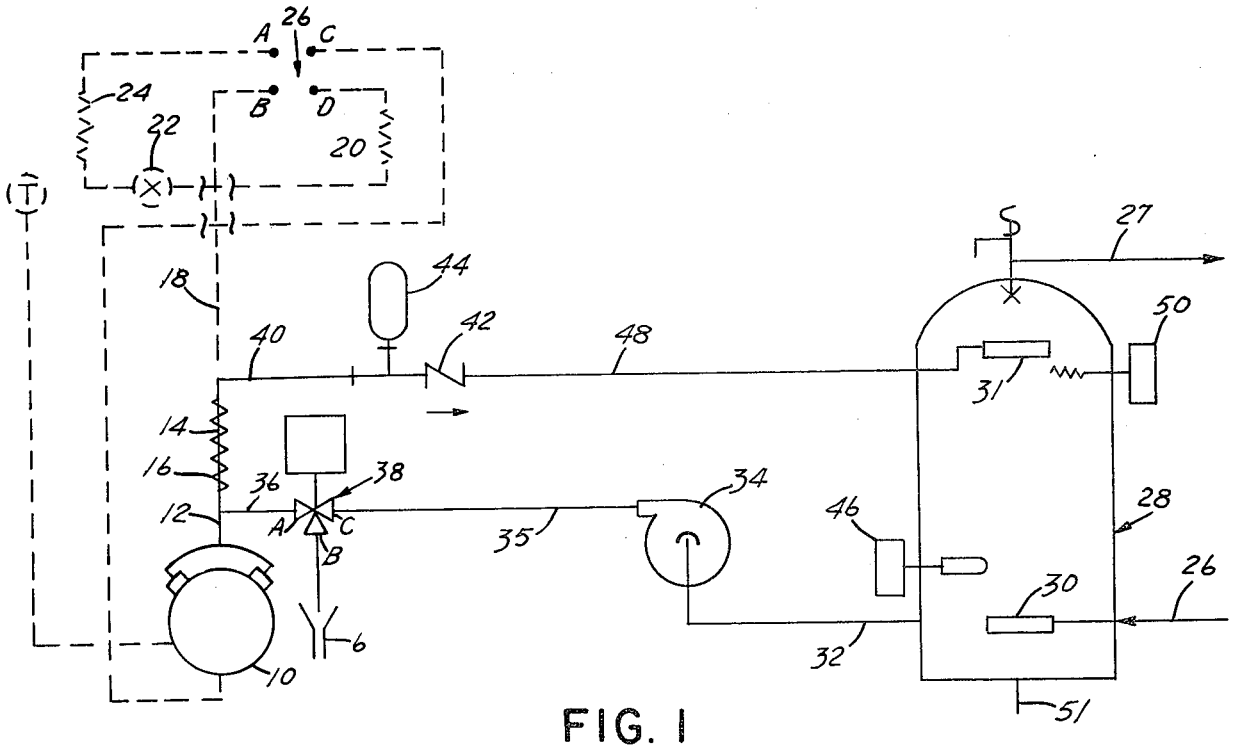
FIG. 1 is a schematic diagram of a vapor compression refrigeration system and a hot water system provided with the claimed apparatus such that heat energy may be transferred between the refrigerant and water to be heated; and, FIG. 2 is a view partly in section of a hot water storage tank according to the invention illustrating the water inlet and outlet means of the invention.

Referring now to FIG. 1, there can be seen a vapor compression refrigeration system having compressor 10 connected with discharge line 12 to refrigerant conduit 14 of the heat exchanger 16. The refrigerant conduit 14 is connected by condenser inlet line 18 to condenser 20. Condenser 20 is connected to expansion means 22 which is connected to evaporator 24 which is connected to the compressor 10 to complete the closed vapor compression circuit.

A water system is disclosed having water inlet 26 supplying water to hot water tank 28. Water inlet 26 has a water inlet extension 30 which will be explained in more detail later.

Feedline 32 is connected to pump 34 which is connected to the inlet 36 of heat exchanger 16 via a two-position three-way automatic drain valve 38. The outlet 40 of the heat exchanger 16 is connected to the hot water supply tank 28 via check valve 42 with air bottle 44 communicating with the downstream side of the check valve 42 being connected to the outlet of heat exchanger outlet 40 of heat exchanger 16. The hot water storage tank 28 is provided with hot water tank high temperature limit switch 46 which is electrically connected by suitable electrical circuitry to activate the two-position three-way automatic drain valve 38 whenever the water temperature in the storage tank exceeds a predetermined setting of the limit switch 46. The normal flow of water through valve 38 is in through inlet 38C and out through outlet 38A. When the upper high limit of switch 46 is reached, switch 46 activates, valve 38C is closed, and valve 38B is opened allowing communication between and flow of water through valves 38A and 38B. When the upstream pressure on conduit 48 between the check valve 42 and hot water tank 28 exceeds the downstream pressure in conduit 40, check valve 42 will be actuated. The air pressure in bottle 44 is maintained sufficient to purge all of the water in liquid form from the heat exchanger and conduits 40 and 36 through exit valve 38B.

OPERATION

When a demand is sensed such that the refrigeration circuit is operated for supplying heating or cooling, compressor 10 is energized. Once the compressor 10 is energized, hot refrigerant gas is discharged to the heat exchanger 16. This hot gas contains thermal energy including superheat energy, i.e. the energy rejected to cool the gas to its saturation temperature, and the heat of condensation which is the heat energy necessary to condense the refrigerant to a liquid. In the condenser 24, the heat of condensation of the refrigerant is rejected to a heat transfer media in heat transfer relation therewith.

As long as the high temperature sensor 46 in the hot water storage tank is below the preset upper limit temperature, valve 38 is actuated, closing valve port 38C and the outlet from the pump 34 so no water is pumped through the heat exchanger 16. When the temperature in the hot water storage tank falls below the maximum temperature to which the sensing valve 46 is set, the valve 38 is activated to provide a connection between inlet 38C and outlet 38A such that water is pumped through the heat exchanger 16 and back to hot water storage tank 28 via valve 42. Thus, if no outlet water is being withdrawn from the hot water storage tank, the temperature of the water therein may reach the predetermined high temperature limit to which switch 46 has been set.

A pressure-enthalpy diagram for Refrigerant 22 shows heat is available and superheated R-22 gas at the compressor discharge has a temperature of up to 360° F. From the steam tables and in particular Table 1 on page 32 of "Thermodynamic Porperties of Steam" by Keenan and Keyes published by John Wiley & Sons, Copyright 1936, which is incorporated herewith by reference, it is shown that water at a temperature of 360° F. boils at pressures below 153.04 p.s.i.a. Boiling in a domestic water heating system is undesirable, is very dangerous and must be avoided. None of the prior art workers recognized the boiling water problem and hazard and no means has previously been provided to prevent or avert this problem. Full reliance apparently has been placed on the water or coolant employed being under enough pressure at all times to preclude boiling. The present invention provides an automatic and fail-safe way of avoiding boiling by having water in the refrigerant to water heat exchanger only under controlled conditions, then draining the water from the heat exchanger completely so that no water is present to boil during times when heating of water is not called for. When water is not being heated, the superheat as well as the heat released in condensing refrigerant is removed from the refrigerant by the regular condenser 20.

Figure 2:
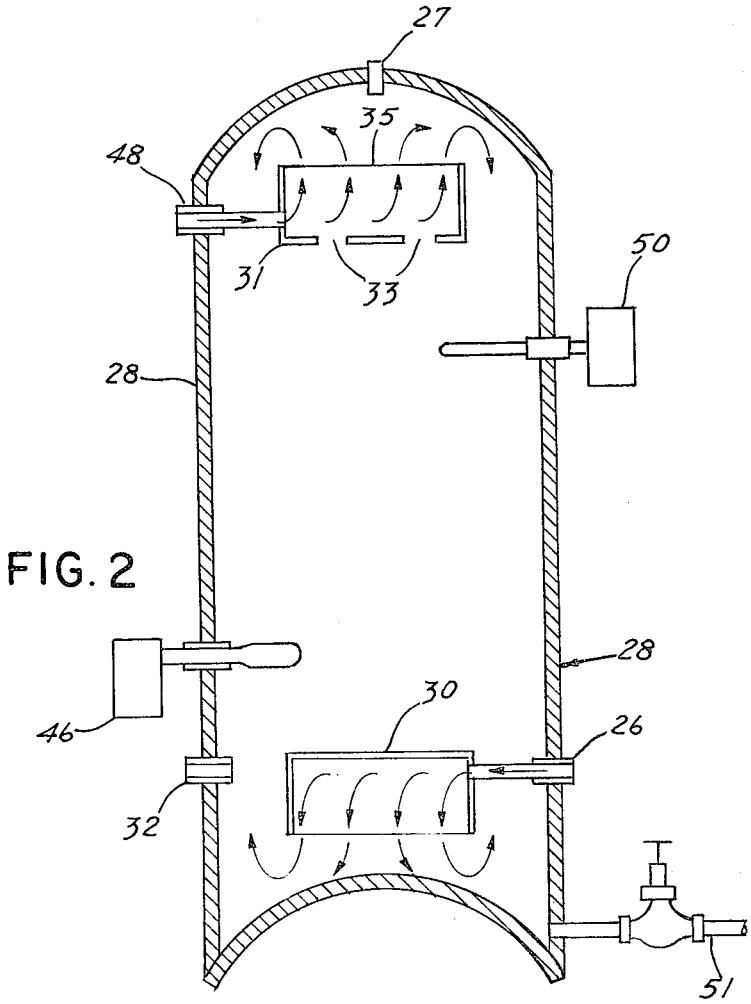

FIG. 2 shows a cross sectional view of a hot water storage tank 28 having a cold water supply inlet 26 and a cold water outlet 32 which is connected to the inlet of pump 34, FIG. 1. Connected to the cold water supply inlet 26 interiorly of the tank 28 is a cold water expanding inlet nozzle 30 which may be a rectangular compartment having a closed top and the bottom open, such that incoming cold water through inlet 26 expands downwardly from the nozzle into the body of water within the hot water storage tank. An outlet 27 is provided at the top of the tank to direct heated water to its ultimate use. A cold hot water inlet 48 for water having been pumped through the heat exchanger 16 and back to the storage tank is provided internally of the storage tank 28 with an expanding inlet nozzle 31 which may be of a rectangular configuration; however, the top 35 thereof is open and the bottom is provided with sediment holes or openings 33 to permit any sediment to pass therethrough for discharge from the bottom of the storage tank through drain 51. The heated water expanding inlet nozzle 31 and the cold water expanding inlet nozzle 30 are configured to permit the introduction both of cold and hot water into the storage tank in a manner to avoid turbulence and to maintain a reasonsably quiescent interface between the incoming cold water and incoming hot water.

As seen from the above description and disclosure, the present invention resides in the water side of the refrigerant cycle being utilized to heat hot water to be stored in a hot water storage tank that is particularly adapted for use in any refrigeration cycle where heat at a sufficiently high temperature is available and can be employed for heating water. The hot water heating system is preferably disposed close to the refrigeration compressor and includes a hot water storage tank which may also include a standby heater. When the refrigeration compressor operates in a response to load requirements, cool water from the lower portion of the hot water storage tank 28 is circulated by the circulator pump 34 through the double-walled superheated refrigerant to water heat exchanger 16 where the water is heated and pumped back to the upper portion of the hot water storage tank. Water at a higher temperature will reside in the upper part of the storage tank because of the lower density thereof than the cold water which will reside in the lower portion of the storage tank. Again, in the preferred configuration, the hot water storage tank is insulated to reduce heat loss by conduction and radiation from the tank surface. When hot water is withdrawn from the storage tank, it is drawn from the top of the tank through conduit 27 where the hottest water resides and cold water flows horizontally into the lower portion of the tank through an expanding inlet nozzle 30 inside the tank. The expanding inlet nozzle 30 eliminates perturbation of the thermally stratified water in the tank, and gently releases the cold inlet water at the bottom of the tank so that the interface between the colder inlet water and the warmer stored water is free of turbulence which would cause mechanical mixing. The cold water rises uniformly in the tank as hot water is withdrawn from the top of the tank. Likewise, the heated water from the heat exchanger 16 is introduced into tank 28 through conduit 48 through an expanding nozzle 31 in the upper portion of the storage tank to eliminate turbulence and to cause a gentle lowering of the interface between the upper lighter hot water and the lower heavier cold water.

When the refrigerant compressor is not operating, the standby heater may be operated to maintain a desired water temperature in the upper 20%-30% of the tank. The standby heater is operated automatically by a thermostatically controlled switch 50 which closes when the temperature of the storage tank water drops below a desired temperature. Switch 50 opens when the water temperature rises to the desired level. The thermostatic switch 50 may be mechanical or electric, and the standby heater energy source may be gas, oil, electric power or any energy source which can be automatically controlled by the switch. The switch 50 is located in the upper portion of the storage tank to conserve the standby fuel or energy while providing a limited but satisfactory hot water reserve in the storage tank during those times the refrigeration cycle is inoperative.

A hot water storage tank drain and blowdown valve 51 is located at the bottom of the tank 28. This drain valve should be opened on a regular basis to remove sediment from the tank bottom and prevent incoming cold water perturbating the sediment and causing turbidity in the hot water supply.

When the water temperature in the hot water storage tank increases to the setting of the high temperature limit switch 46, the limit switch actuates the two-position three-way automatic valve 38 to close the normal open port 38C and open normally closed port 38B with port 38A remaining open where port 38C is closed and port 38A is open to 38B. This allows the water in the pipes 36 and 40 from port 38A to the check valve 42 to begin to drain through port 38B. This causes the check valve 42 to begin to drain out of port 38B and resulting in check valve closing and being held shut by the now higher pressure on the storage tank side of the check valve. This sequence isolates the piping and water side of the superheated refrigerant to water double-walled heat exchanger from the water stored in the hot water storage tank. The compressed air provided in the air bottle 44 is allowed to expand and exit its system through port 38B carrying all the water with it that was previously contained in the exchanger 16. Thus, the removal of water from the heat exchanger 16 prevents the generation of steam and overheated water which would result if this water were allowed to remain in the heat exchanger.

When the water temperature in the hot water storage tank at the high temperature limit falls to some temperature below the high temperature limit, the two-position three-way valve returns to the normal position with port 38C open to port 38A and portion 38B closed. Water under pressure enters the heat exchanger through port 38C and 38A pressing the trapped air back into the bottle and equalizing the water pressure on both sides of the check valve 42. Thus, the system is ready for normal operation and water heating when the refrigerant compressor operates. The water circulator may be a pump to which mechanical energy is applied to perform work where it is required to overcome friction of waterflow, or it may merely be the thermo siphon effect caused by heating the water in the heat exchanger so long as the heat elevation is not in the middle of the hot water storage tank elevation and the pumps running from the bottom of water storage tank 28 through the heat exchanger 16 back to the top of the storage tank never run downhill in the direction of the waterflow. The use of the thermo siphon feature is important for cost saving and energy conservation.

An essential feature of the air bottle 44 is the volume which is connected to the heater side of the check valve. It is not desirable to inject trapped air into the hot water storage tank when the heat exchanger loop refills with water after a draindown cycle. The air bottle should have a sufficient volume to completely evacuate the water from the heat exchanger loop through port 38B of the three-way two-position automatic drain valve when the check valve closes. If the air pressure is slightly greater than the atmospheric pressure then when the heat exchanger heat loop is refilled with water, all the air trapped in this loop should be compressed into the air bottle before water pressure equalizes on both sides of the check valve 42 allowing same to close. The air bottle volume should be such that the compressed air resides in the upper part of the bottle with sufficient water in the lower part of the bottle to contain the compressed air in the bottle under normal water pressure operating ranges. The air bottle can be a simple tank made of a piece of pipe capped on each end or a more sophisticated tank containing a sanitary compressible diaphragm or bladder. The bottom of the air bottle should be connected to the high point in the inlet side of the check valve to allow all compressed air to naturally flow upwards into the air bottle as the heat exchanger loop refills with water.

The present invention is a hot water heating subsystem in a refrigeration cycle system that serves another basic thermal load by employing the available heat in the superheated refrigerant between the compressor discharge and the condenser. It is totally different in principle and process system where all of the condenser heat of the refrigerant cycle is employed to heat hot water.

While there have been described what at present are considered to be the preferred embodiments of this invention, it will be obvious to those skilled in the art that various changes and modifications may be made therein without departing from the invention. It is aimed, therefore, in the appended claims to cover all such changes and modifications which fall within the true spirit and scope of the invention.

What is claimed is:

1. A combination hot water heater, refrigerant desuperheater assembly for use in conjunction with a refrigeration circuit in a hot water system which comprises:

a water inlet for receiving water to be heated;

a refrigerant inlet for receiving the refrigerant;

a water outlet for discharging water;

a refrigerant outlet for discharging refrigerant;

heat exchange means for transferring heat energy between the refrigerant and the water, said heat exchange means being connected to the refrigerant inlet and the refrigerant outlet;

pump means having an inlet and an outlet, with the outlet connected to the water inlet for circulating water through the assembly;

first pipe means connecting the pump means to the heat exchange means;

second pipe means connecting the heat exchange means to the water outlet;

a first valve means associated with the first pipe means, said valve having an open position allowing waterflow from the water inlet to the heat exchange means and a closed position preventing waterflow from the water inlet to the heat exchange means but permitting flow from the heat exchange means to a drain;

a one way second valve means associated with the second pipe means, said valve having an open position allowing waterflow from the heat exchange means to the water outlet and a closed position preventing waterflow from the heat exchange means to the water outlet; and, including a hot water storage tank having at least one inlet and one outlet with an outlet thereof connected to the pump inlet and an inlet thereof connected to the water outlet wherein the storage tank includes a cold water inlet and a hot water outlet, wherein the cold water inlet is connected to a cold water expanding inlet nozzle positioned within the tank and the hot water outlet is connected to a hot water expanding inlet nozzle positioned within the tank.

2. A combination hot water heater, refrigerant desuperheater assembly for use in conjunction with a refrigeration circuit in a hot water system which comprises:

a water inlet for receiving water to be heated;

a refrigerant inlet for receiving the refrigerant;

a water outlet for discharging water;

a refrigerant outlet for discharging refrigerant;

heat exchange means for transferring heat energy between the refrigerant and the water, said heat exchange means being connected to the refrigerant inlet and the refrigerant outlet;

pump means having an inlet and an outlet, with the outlet connected to the water inlet for circulating water through the assembly;

first pipe means connecting the pump means to the heat exchange means;

second pipe means connecting the heat exchange means to the water outlet;

a first valve means associated with the first pipe means, said valve having an open position allowing waterflow from the water inlet to the heat exchange means and a closed position preventing waterflow from the water inlet to the heat exchange means but permitting flow from the heat exchange means to a drain;

a one way second valve means associated with the second pipe means, said valve having an open position allowing waterflow from the heat exchange means to the water outlet and a closed position preventing waterflow from the heat exchange means to the water outlet; and, including a hot water storage tank having at least one inlet and one outlet with an outlet thereof connected to the pump inlet and an inlet thereof connected to the water outlet wherein the storage tank includes a cold water inlet and a hot water outlet, wherein the cold water inlet is connected to a cold water expanding inlet nozzle positioned within the tank and the hot water outlet is connected to a hot water expanding inlet nozzle positioned within the tank wherein the cold water expanding inlet nozzle comprises a closed top open bottom chamber connected to the cold water inlet and the hot water expanding outlet nozzle comprises an open top closed bottom chamber with openings in the bottom connected to the hot water outlet.

* * * * *